US012082681B2

(12) United States Patent
Siow et al.

(10) Patent No.: US 12,082,681 B2
(45) Date of Patent: Sep. 10, 2024

(54) THERMAL INSULATION BACKPACK, AND OPERATION METHOD THEREOF

(71) Applicant: GLOBAL HEALTHCARE SG PTE. LTD., Singapore (SG)

(72) Inventors: Ming Qian Siow, Singapore (SG); Keng Liang Cheng, Singapore (SG); Hongjin Liu, Jiangxi (CN)

(73) Assignee: GLOBAL HEALTHCARE SG PTE. LTD., Singapore (SG)

( * ) Notice: Subject to any disclaimer, the term of this patent is extended or adjusted under 35 U.S.C. 154(b) by 129 days.

(21) Appl. No.: 17/784,194

(22) PCT Filed: Apr. 13, 2020

(86) PCT No.: PCT/CN2020/084403
§ 371 (c)(1),
(2) Date: Jun. 10, 2022

(87) PCT Pub. No.: WO2021/114532
PCT Pub. Date: Jun. 17, 2021

(65) Prior Publication Data

US 2023/0026473 A1 Jan. 26, 2023

(30) Foreign Application Priority Data

Dec. 11, 2019 (CN) ..... 201911268056.4

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45F 2003/122; A45F 2003/125; F25D 11/003

(Continued)

(56) References Cited

U.S. PATENT DOCUMENTS 1,300,611 A * 4/1919 Henemier ..... F16K 31/58 152/429
2,984,994 A * 5/1961 Hankins ..... F25B 9/00 62/448

(Continued)

FOREIGN PATENT DOCUMENTS

CN 2624693 Y 7/2004
CN 105615519 A 6/2016

(Continued)

OTHER PUBLICATIONS

Amtel AT89C2051 Microcontroller Data Sheet. (Year: 2005).*
International Search Report for PCT application No. PCT/CN2020/084403 dated Sep. 15, 2020.

*Primary Examiner* — Scott T McNurlen
(74) *Attorney, Agent, or Firm* — Muir Patent Law, PLLC

(57) ABSTRACT

A thermal insulation backpack comprises a main body and an adapter assembly. The main body has a thermal insulation accommodation cavity and a connection hole in communication with the thermal insulation accommodation cavity. The adapter assembly comprises a fixing frame, a sealing screen, and a reset assembly. An outer periphery of the sealing screen has a sealing strip protruding outward. The fixing frame includes a connection recess and a first through slot. The first through slot is connected to the thermal insulation accommodation. The sealing screen is connected to the reset assembly. When the adapter assembly is not connected to an external cooling apparatus, the sealing strip presses against a lower end of the connection recess and when connected to an external cooling apparatus, the sealing screen moves toward the interior of the thermal insulation accommodation cavity and the connection recess is communicated with the first through slot.

9 Claims, 7 Drawing Sheets

(58) Field of Classification Search
USPC ..... 251/330, 341, 349, 354
See application file for complete search history.

(56) References Cited

U.S. PATENT DOCUMENTS

| | | | | |
|---|---|---|---|---|
| 2019/0075912 | A1 | 3/2019 | Squires | |
| 2019/0183235 | A1* | 6/2019 | Yang | H02S 30/00 |

FOREIGN PATENT DOCUMENTS

| | | | | | |
|---|---|---|---|---|---|
| CN | 105876917 | A | | 8/2016 | |
| CN | 207055145 | U | | 3/2018 | |
| CN | 208278667 | U | | 12/2018 | |
| CN | 110150835 | A | * | 8/2019 | |
| CN | 110150836 | A | | 8/2019 | |
| CN | 211092330 | U | | 7/2020 | |
| CN | 110772018 | B | | 6/2021 | |
| KR | 2017130799 | A | * | 11/2017 | A45C 11/20 |

* cited by examiner

THERMAL INSULATION BACKPACK, AND OPERATION METHOD THEREOF

The present application is based on and claims priority of the Chinese Patent Application filed on Dec. 11, 2019 with the application number of 201911268056.4, the entire contents of which are incorporated herein by reference.

TECHNICAL FIELD

The present application relates to a thermal insulation system, in particular to a thermal insulation backpack and an operation method thereof.

BACKGROUND

Thermal insulation bags are used for either open-air picnics or daily life, and are used for accommodating a variety of foods and keeping temperature and freshness of the foods, which belong to one of outdoor bags. In the current thermal insulation bags, foods pending thermal insulation are put into the thermal insulation bags, but temperature of the foods being insulated thermally will elevate slowly over time, resulting in incapability of insulating the foods for a long time; and the foods have to be taken out of the bags for reducing the temperature, if necessary, and then, are put into refrigerators to achieve a thermal insulating effect, and thus, the thermal insulation bags are not applicable to emergency circumstances, which are not convenient to operate.

Therefore, it is necessary to design a new backpack, which may achieve quick cooling and achieve the thermal-insulating effect without taking the products out of the backpack. The backpack is applicable to the emergency circumstances, and is easy to operate.

SUMMARY OF INVENTION

The present application aims to provide a thermal insulation backpack and an operation method thereof to overcome defects in the prior art.

For the above purpose, the present application mentions the following technical scheme: the thermal insulation backpack includes a main body and one or more adapter assemblies, where the main body is internally provided with a thermal insulation accommodation cavity; connection holes are formed in the main body and are communicated with the thermal insulation accommodation cavity; each adapter assembly is inserted into the respective connection hole, and includes a fixing frame, a sealing screen, and a reset assembly; an outer periphery of the sealing screen is provided with a sealing strip protruding outward; a connection recess and a first through slot are formed in the fixing frame; the first through slot is connected with the thermal insulation accommodation cavity; the sealing screen is connected with the reset assembly; when the adapter assembly is connected with an external cooling apparatus, the sealing screen moves to be close to an inside of the thermal insulation accommodation cavity, so that the connection recess is communicated with the first through slot; when the adapter assembly is not connected with the external cooling apparatus, the sealing screen moves away from the inside of the thermal insulation accommodation cavity; and the sealing strip presses against a lower end of the connection recess to avoid communication between the connection recess and the first through slot.

As a further technical scheme, the fixing frame includes a frame body and hooks which are connected in the frame body; each hook is connected with the reset assembly; the connection recess and the first through slot are formed in the frame body; the frame body presses against the connection hole; and each hook is arranged on an inner wall of the first through slot.

As a further technical scheme, the reset assembly includes a connecting disc and a return spring; the connecting disc is connected with each hook; a lower end of the return spring is connected with the connecting disc, and an upper end of the return spring is connected with the sealing screen; and the connecting disc presses against the connection hole.

As a further technical scheme, an upper end of the connecting disc extends upwards to form a connecting ring; the connecting ring is internally provided with a plurality of necks; and the hooks are connected in the necks.

As a further technical scheme, a fixing sheet is connected to an outer end of the connecting disc, and presses against an outer end of the connection hole; and an insert hole is formed in the fixing sheet, where the connecting disc is inserted.

As a further technical scheme, an inner wall of the insert hole is provided with a plurality of connecting blocks protruding inward, and the connecting blocks are connected with the frame body; a second through slot is formed between the adjacent connecting blocks; and the first through slots, the second through slots, and the thermal insulation accommodation cavity are communicated with each other.

As a further technical scheme, a connector is also connected to an upper end of the sealing screen, and includes a connecting tube; a bar-type groove is formed in a side wall of the connecting tube; and a seal sheet is arranged at one end of the connecting tube, close to the sealing screen.

As a further technical scheme, a temperature display screen is connected to the main body; and a temperature sensor is connected in the thermal insulation accommodation cavity. The thermal insulation backpack further includes a master control chip U1; and the temperature display screen and the temperature sensor are respectively connected with the master control chip U1.

As a further technical scheme, the master control chip U1 has a model of AT89C2051.

The present application further provides an operation method of the thermal insulation backpack, in which the thermal insulation backpack is used. The operation method includes:

When the thermal insulation backpack is in an initial state, the return spring keeps an original length; the sealing screen drives the sealing strip to be arranged at a communication position of the connection recess and the first through slot under an action of the return spring, so that the connection recess is not communicated with the first through slot.

When the thermal insulation backpack needs to be cooled, the external cooling apparatus is connected with the connection recess; the external cooling apparatus supplies cold air, which acts on the sealing screen, so that the sealing screen moves close to the thermal insulation accommodation cavity to compress the return spring; and the connection recess is communicated with the first through slot, so that the cold air passes through the connection recess, the first through slot, and each of the second through slots sequentially, and then, enters the thermal insulation accommodation cavity for cooling.

Compared with the prior art, the present application has the beneficial effects: the connection holes are formed in the main body, the adapter assemblies are inserted into the connection holes, and the connection recesses are communicated with and separated from the first through slots by the sealing screens, the sealing strips, and the return springs; when the thermal insulation accommodation cavity needs to be cooled internally by the external cooling apparatus, the cold air outputted from the external cooling apparatus acts on the sealing screens, so that the sealing strips are separated from the communication positions of the connection recesses and the first through slots, which makes the cold air get into the thermal insulation accommodation cavity; or else, the sealing strips are hermetically arranged at the communication positions of the connection recesses and the first through slots to seal the thermal insulation accommodation cavity, which achieves quick cooling without taking the products out of the thermal insulation accommodation cavity, while achieving the thermal-insulating effect. The thermal insulation backpack is applicable to the emergency circumstances, and is easy to operate.

The present application will be further described with reference to drawings and embodiments.

BRIEF DESCRIPTION OF THE DRAWINGS

In order to more clearly illustrate the technical schemes of embodiments of the present application, the drawings needed in description of the embodiments will be simply introduced, obviously, the drawings in the description below are some embodiments of the present application, and a person of ordinary skill in the art can obtain other drawings according to these drawings without involving creative labor.

DETAILED DESCRIPTION OF THE EMBODIMENTS

Figure 1:
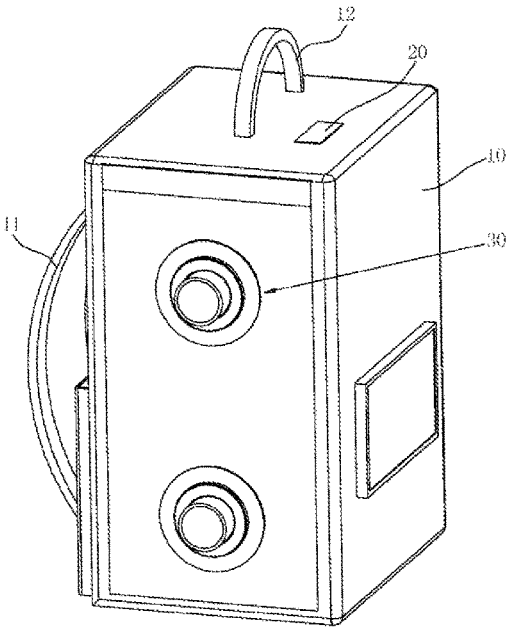
FIG. 1 depicts a three-dimensional structural schematic diagram illustrating a thermal insulation backpack, provided in one embodiment of the present application.

To make the objectives, the technical schemes and the advantages of the present application clearer, the present application will be further described in detail with reference to drawings and embodiments.

The following will clearly and completely describe the technical schemes in the embodiments of the present application with reference to the drawings in the embodiments of the present application, and apparently the described embodiments are merely part of rather than all embodiments of the present application. Based on the embodiments in the present application, all other embodiments obtained by those ordinarily skilled in the art without involving creative labor belong to the protection scope of the present application.

In the description of the present application, it should be understood that orientation or position relationships indicated by terms "center", "longitudinal", "lateral", "length", "width", "thickness", "upper", "lower", "front", "rear", "left", "right", "vertical", "horizontal", "top", "bottom", "inner", "outer", "clockwise", "counter-clockwise", and the like are orientation or position relationships shown in the drawings, are adopted not to indicate or imply that indicated devices or components must be in specific orientations or structured and operated in specific orientations but only to conveniently describe the present application and simplify the description, and thus should not be understood as limits to the present application.

Moreover, terms "first" and "second" are merely used for descriptive purposes, but are not to be construed as indicating or implying the relative importance or implicitly indicating the number of indicated technical features. Thus, features defining "first" and "second" may include one or more of the features, explicitly or implicitly. Unless otherwise explicitly specified, "a plurality of" indicates two or more in the description of the present application.

In the present application, unless otherwise explicitly specified and defined, terms "install", "link", "connect", "fix", and other terms should be broadly understood. For example, the terms may refer to connection and may also refer to detachable connection or integrated connection. The terms may refer to mechanical connection, and may also refer to electrical connection. The terms may refer to direct connection, may refer to indirect connection through a medium, and may refer to communication in two elements or interaction between two elements. For a person of ordinary skill in the art, specific meanings of these terms in the present application may be understood according to the specific condition.

In the present application, unless otherwise explicitly specified and defined, a position where the first feature is "on" or "below" the second feature may refer to direct contact of the first and the second features, and may also refer to contact between the first and the second features by an additional feature, rather than direct contact. Moreover, positions where the first feature is "on", "above" and "over" the second feature may refer to those where the first feature is over or above the second feature, or merely indicate that the horizontal height of the first feature is larger than that of the second feature. Positions where the first feature is "under", "below" and "underneath" the second feature may refer to those where the first feature is under or below the second feature, or merely indicate that the horizontal height of the first feature is smaller than that of the second feature.

In the description of the specification, with reference to descriptions of reference terms "one embodiment", "some embodiments", "example", "specific example", "some examples", or the like, it means that specific features, structures, materials, or characteristics as described in combination with the embodiment or the example are included in at least one embodiment or example of the present application. In the specification, the schematic representation of the above terms should not be construed as necessarily referring to the same embodiment or example. Moreover, the described specific features, structures, materials or characteristics may be combined in any one or more embodiments or examples in a proper manner. In addition, a person skilled in the art may incorporate and combine different embodiments or examples as described in the specification.

For the embodiments as shown in FIGS. 1-10, a thermal insulation backpack provided by the embodiment may be used indoors or outdoors, and may also be used in emergency circumstances. When in use, the thermal insulation backpack may be taken away directly, which is convenient and quick; and when the products in the thermal insulation backpack need to be cooled, products may be cooled quickly and conveniently in the thermal insulation backpack, without being taken out of the thermal insulation backpack.

Figure 2:
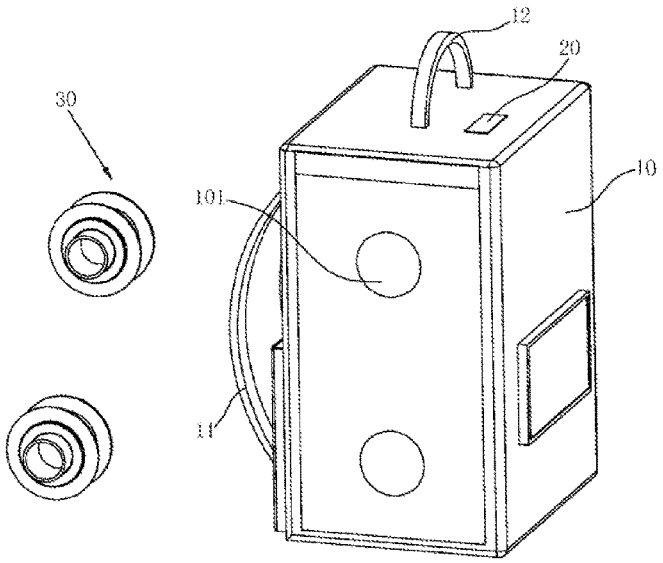
FIG. 2 depicts an exploded view illustrating a thermal insulation backpack, provided in one embodiment of the present application.
Figure 3:
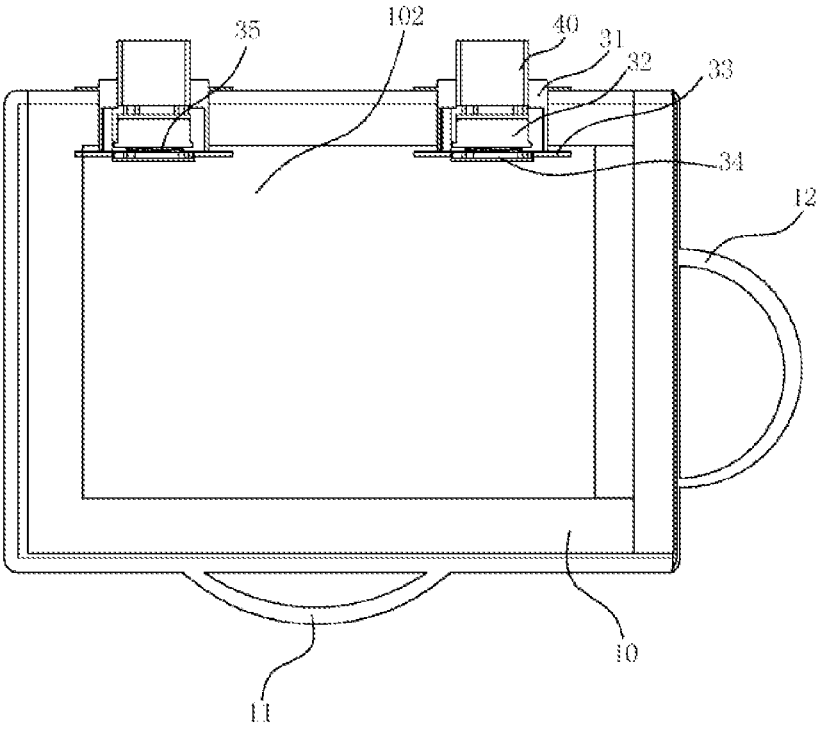
FIG. 3 depicts a left view illustrating a thermal insulation backpack at a cooling state, provided in one embodiment of the present application.

By referring to FIGS. 1-3, the thermal insulation backpack includes a main body 10 and adapter assemblies 30, where the main body 10 is internally provided with a thermal insulation accommodation cavity 102; and connection holes 101 are formed in the main body 10 and are communicated with the thermal insulation accommodation cavity 102, so that external cooling apparatus is communicated with the thermal insulation accommodation cavity 102 to cool the products in the thermal insulation accommodation cavity 102, without taking the products out.

Figure 4:
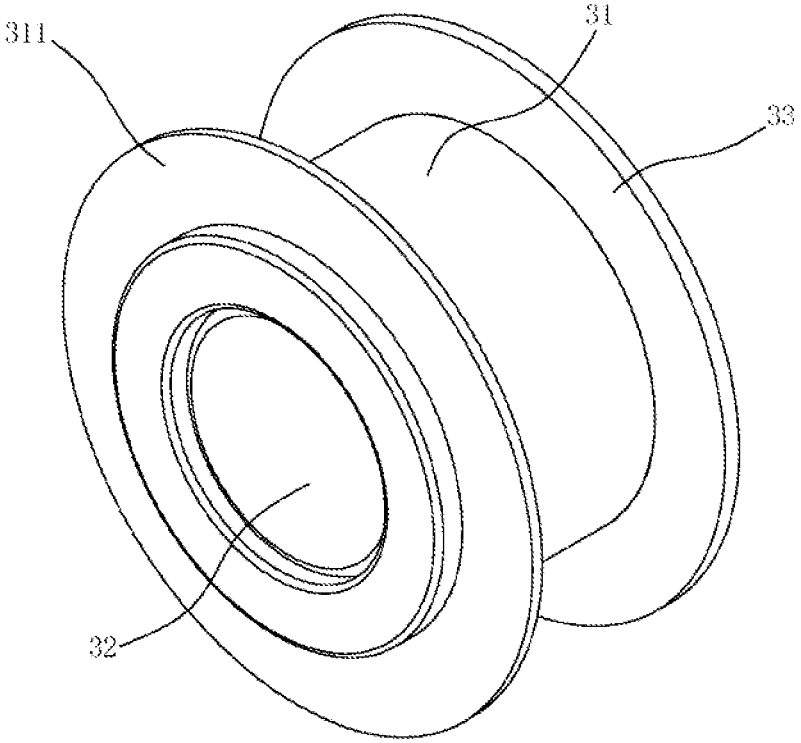
FIG. 4 depicts a three-dimensional structural schematic diagram I illustrating an adapter assembly, provided in one embodiment of the present application.

Still further, by referring to FIG. 4, each adapter assembly 30 is inserted into the connection hole 101, and includes a fixing frame, a sealing screen 32, and a reset assembly; an outer periphery of the sealing screen 32 is provided with a sealing strip 321 protruding outward; a connection recess 316 and a first through slot 312 are formed in the fixing frame; the first through slot 312 is connected with the thermal insulation accommodation cavity 102; the sealing screen 32 is connected with the reset assembly; when the adapter assembly 30 is connected with the external cooling apparatus, the sealing screen 32 moves close to an inside of the thermal insulation accommodation cavity 102, so that the connection recess 316 is communicated with the first through slot 312; when the adapter assembly 30 is not connected with the external cooling apparatus, the sealing screen 32 moves away from the inside of the thermal insulation accommodation cavity 102, and the sealing strip 321 presses against a lower end of the connection recess 316 to avoid communication between the connection recess 316 and the first through slot 312. The sealing screen 32 is driven to move by the reset assembly, so that the connection recess 316 is communicated with and separated from the first through slot 312, which achieves the cooling or sealing of the products in the thermal insulation accommodation cavity 102. The thermal insulation backpack has, therefore, a simple structure, and is easy to operate.

The connection recess 316 is positioned at an upper end of the first through slot 312, a width of the connection recess 316 is smaller than that of the first through slot 312, and a width of the sealing strip 321 is larger than that of the connection recess 316; the connection recess 316 and the first through slot 312 are used as stepped grooves; the sealing screen 32 may be inserted into the connection recess 316 after moving to seal the connection recess 316; the sealing strip 321 is positioned at an outer end of a half bottom of the sealing screen 32 for sealing the connection recess 316, which may ensure a thermal-insulating effect of the thermal insulation accommodation cavity 102 by improving the leakproofness when the first through slot 312 is not communicated with the connection recess 316 in case that cooling is not implemented by the external cooling apparatus, thereby.

Figure 6:
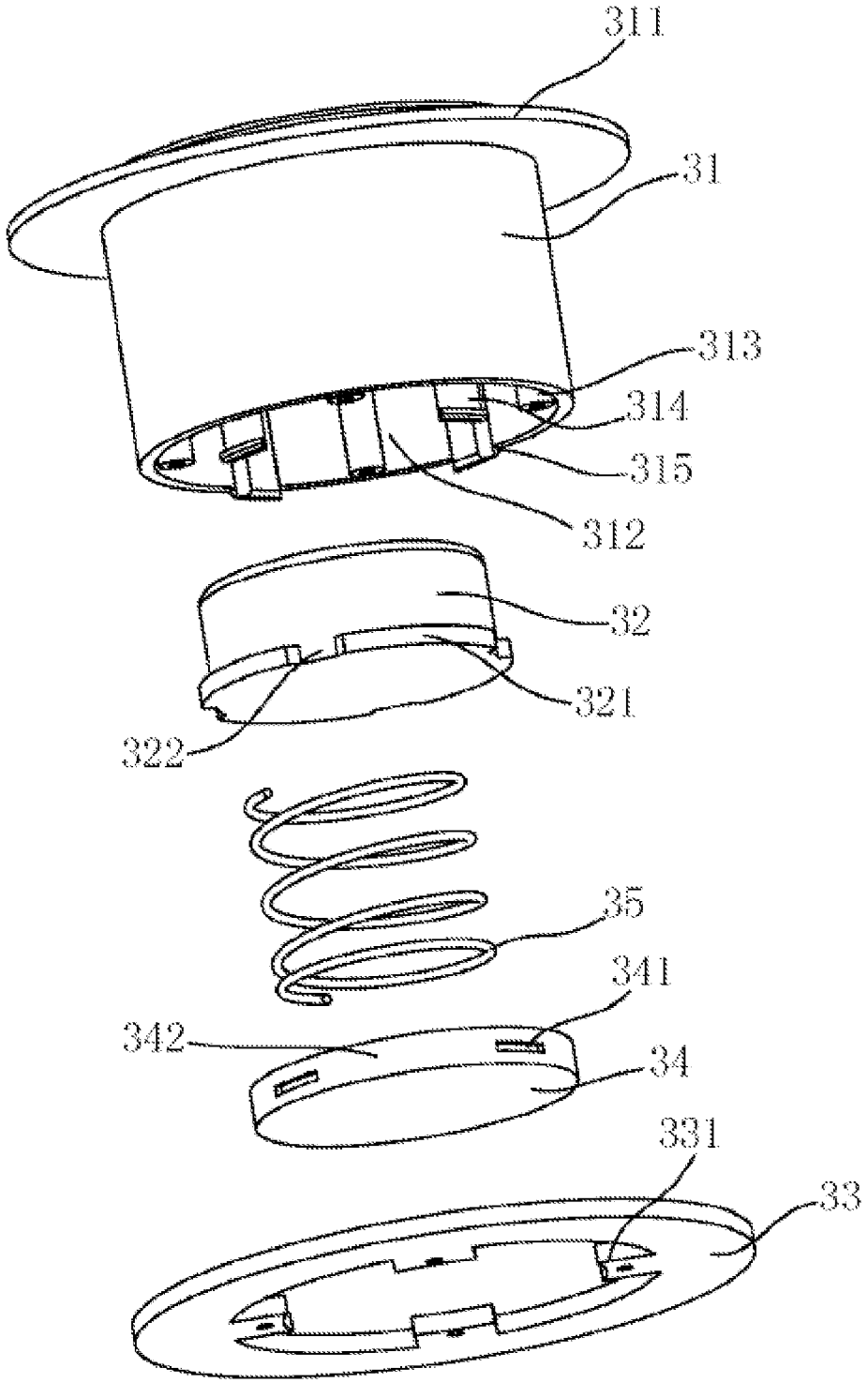
FIG. 6 depicts an exploded view illustrating an adapter assembly, provided in one embodiment of the present application.

In one embodiment, by referring to FIG. 6, the fixing frame includes a frame body 31 and hooks which are connected in the frame body 31; each hook is connected with the reset assembly; the first through slot 312 and the connection recess 316 are formed in the frame body 31; the frame body 31 presses against the connection hole 101; and the hook is arranged on an inner wall of the first through slot 312, so that the reset assembly is fixed by the hook.

Particularly, a spacing ring 311 is arranged at a periphery of the frame body 31, and presses against an outer end of the connection hole 101, so that the frame body 31 presses against the connection hole 101, and the reset assembly is fixed by a connection between the hook and the reset assembly.

Figure 7:
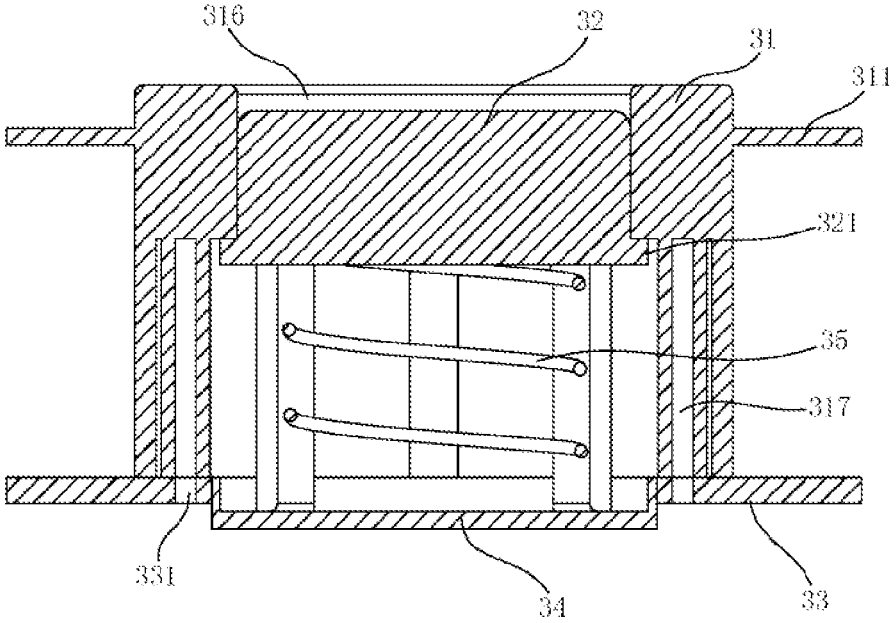
FIG. 7 depicts a sectional view I illustrating an adapter assembly, provided in one embodiment of the present application.

In one embodiment, by referring to FIGS. 6 and 7, the reset assembly includes a connecting disc 34 and a return spring 35; the connecting disc 34 is connected with each hook; a lower end of the return spring 35 is connected with the connecting disc 34, and an upper end of the return spring 35 is connected with the sealing screen 32; and the connecting disc 34 presses against the connection hole 101.

A diameter of the connecting disc 34 is larger than that of the connection hole 101, so that the connecting disc 34 presses against one end of the connection hole 101, close to the thermal insulation accommodation cavity 102, and thus, the return spring 35 and the sealing screen 32 may be arranged in the first through slot 312 and the connection recess 316.

In one embodiment, by referring to FIG. 6, an upper end of the connecting disc 34 extends upwards to form a connecting ring 342; the connecting ring 342 is internally provided with a plurality of necks 341; and the hooks are connected in the necks 341. The necks 341 are connected with the hooks, so that the connecting disc 34 is connected with the frame body 31.

Particularly, a plurality of notches 322 are formed in the sealing strip 321; each hook includes a connecting plate 314 and a reverse hook section 315; the connecting plate 314 is connected in the first through slot 312; the reverse hook section 315 is connected to a lower end of the connecting plate 314, and the connecting plate 314 is arranged in the notch 322; and the reverse hook section 315 is inserted into the neck 341 to avoid interference caused by the connection between the connecting disc 34 and the frame body 31 during the movement of the sealing screen 32.

In the embodiment, the number of the notches 322 is four, and the number of the hooks is four.

Figure 5:
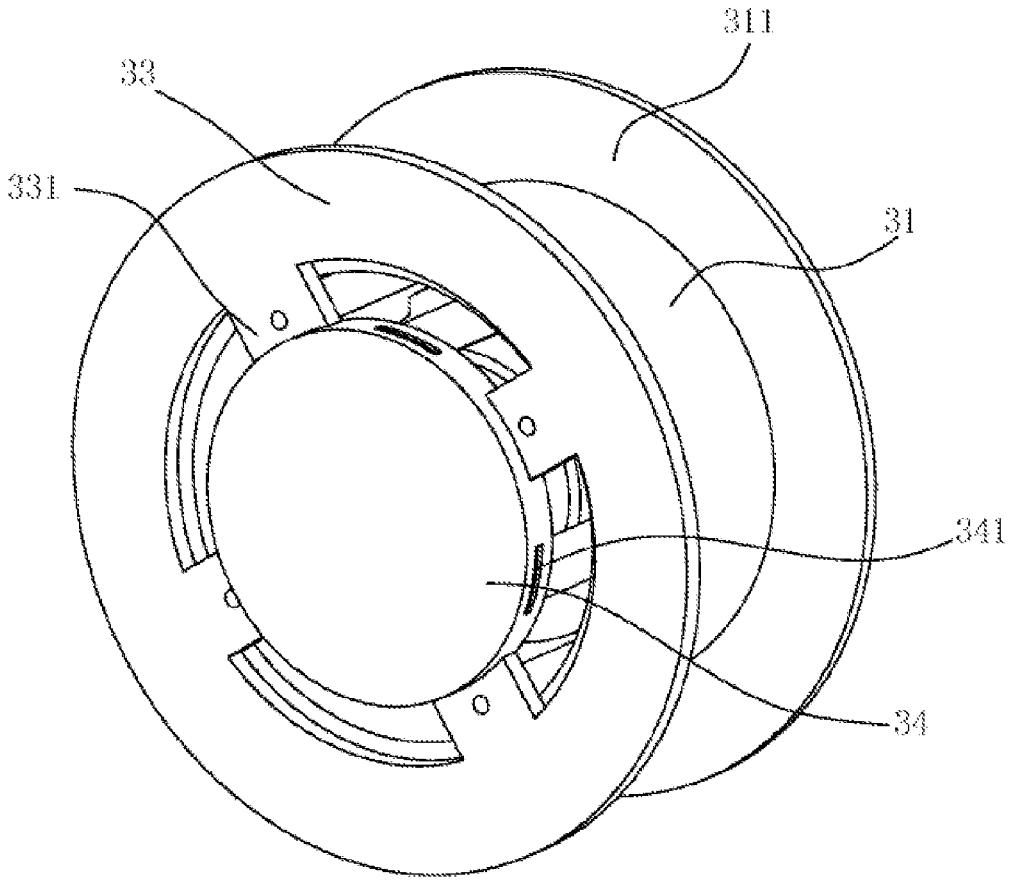
FIG. 5 depicts a three-dimensional structural schematic diagram II illustrating an adapter assembly, provided in one embodiment of the present application.

In one embodiment, by referring to FIG. 5, a fixing sheet 33 is connected to an outer end of the connecting disc 34, and presses against an outer end of the connection hole 101; an insert hole is formed in the fixing sheet 33, where the connecting disc 34 is inserted; and one side of the fixing sheet 33, close to the connecting disc 34, is in an arc shape, and a radian of the arc shape is consistent with an outer radian of the connecting disc 34.

Particularly, an inner wall of the insert hole is provided with a plurality of connecting blocks 331 protruding inward, and connecting blocks 331 are connected with the frame body 31; a second through slot is formed between the adjacent connecting blocks 331; and the first through slots 312, the second through slots, and the thermal insulation accommodation cavity 102 are communicated with each other.

In addition, the frame body 31 is also internally provided with connecting columns 313; each connecting column 313 is arranged in the first through slot 312 and is connected with the connecting block 331; a diameter of the fixing sheet 33 is larger than that of the connection hole 101, and a diameter of the insert hole is larger than that of the connection hole 101; and the connecting block 331 may press against the insert hole, so that the connecting disc 34 is not separated from the connection hole 101, which achieves the fixing of the connecting disc 34. The connecting column 313 is connected with the connecting block 331 by a fastener, and the fastener includes, but is not limited to a screw.

Figure 8:
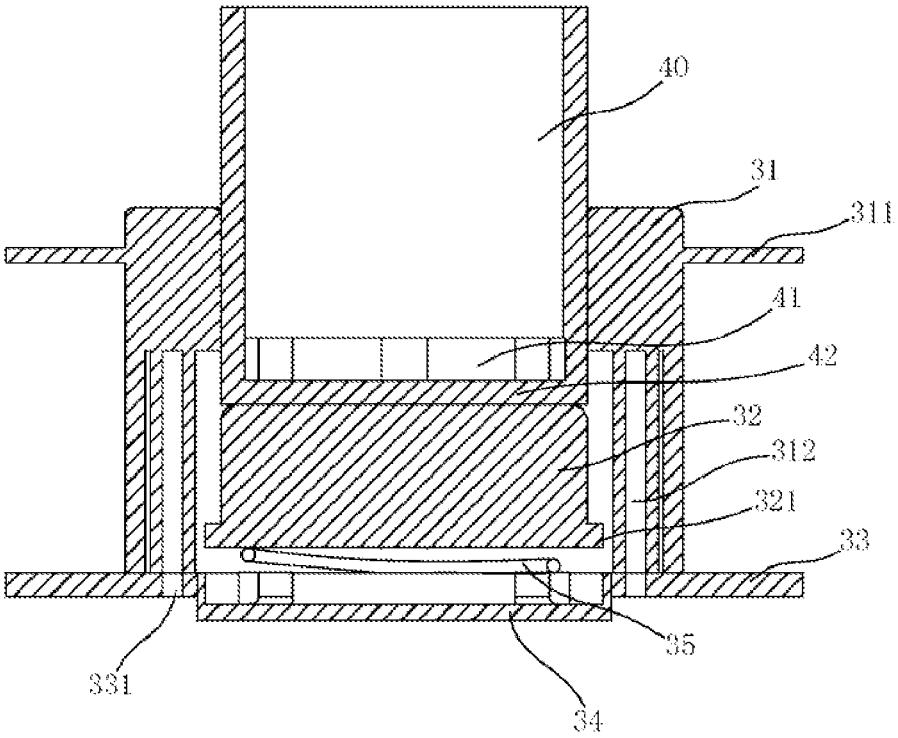
FIG. 8 depicts a sectional view II illustrating an adapter assembly, provided in one embodiment of the present application.

As shown in FIGS. 7 and 8, the refrigerated products may be taken away and thermally insulated at any time in the emergency circumstances; for the products which need to retain freshness and be thermally insulated for a long time in a hospital, when temperature is reduced to temperature at which the freshness of the products may not be retained, as shown in FIG. 7, a tube orifice of a cold air blower is inserted into the connection recess 316, and the sealing screen 32 is driven to move close to the connecting disc 34 under the action of cold air to the sealing screen 32, so that sealing strip 321 is separated from a communication position of the connection recess 316 and the first through slot 312, and the cold air may pass through the connection recess 316, the first through slot 312, and each of the second through slots to enter the thermal insulation accommodation cavity 102 for cooling. In addition, as shown in the FIG. 8, when the cooling has not been implemented yet, the sealing screen 32 seals the communication position of the connection recess 316 and the first through slot 312, so that the overall thermal insulation backpack achieves the thermal-insulating effect. In the emergency circumstances, a person may pick up the thermal insulation backpack immediately before going out; and the thermal insulation backpack may be put into a vehicle for thermal insulation in the open air, and may also be taken away immediately.

In the embodiment, the thermal insulation accommodation cavity 102 is internally provided with a thermal-insulating layer; a through hole is formed in the thermal-insulating layer and is communicated with the connection hole 101; and the frame body 31 is arranged in the through hole and the connection hole 101, and after the sealing screen 32 and the return spring 35 are installed, the fixing sheet 33 is fixed. The thermal insulation backpack is easy to assemble and disassemble. The thermal-insulating layer is made of a vacuum thermal-insulating and high-density foam material.

Figure 9:
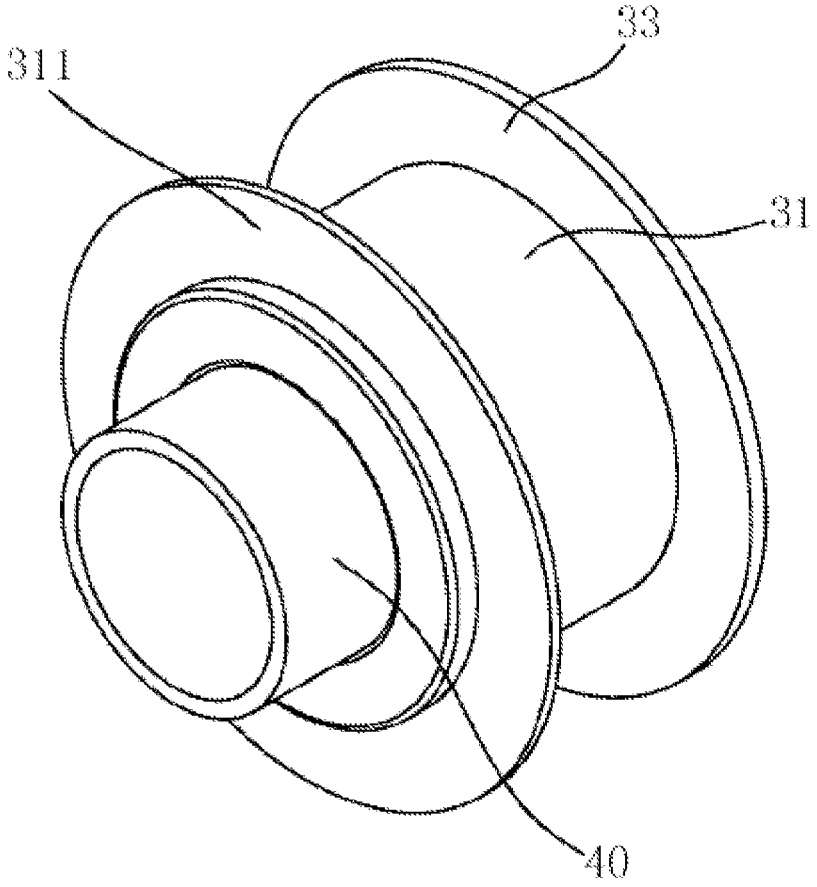
FIG. 9 depicts a three-dimensional structural schematic diagram illustrating an adapter assembly, provided in another embodiment of the present application.

In one embodiment, by referring to FIG. 9, a connector is also connected to an upper end of the sealing screen 32, and includes a connecting tube 40; a bar-type groove 41 is formed in a side wall of the connecting tube 40; and a seal sheet 42 is arranged at one end of the connecting tube 40, close to the sealing screen 32.

The connecting tube 40 is connected with the cold air blower; when the cold air blower operates, the connecting tube 40 drives the sealing screen 32 to move downwards, so that the bar-type groove 41, the connection recess 316, the first through slot 312, and each second through slot are communicated with each other; the cold air is supplied from the connecting tube 40 to the thermal insulation accommodation cavity 102 by the fixing frame; when the cold air blower is taken out, the sealing screen 32 is ejected upwards for sealing by the return spring 35, and the first through slot 312 is in driving fit with the connection recess 316, which achieves the effects of quick cooling and thermal insulation.

Figure 10:
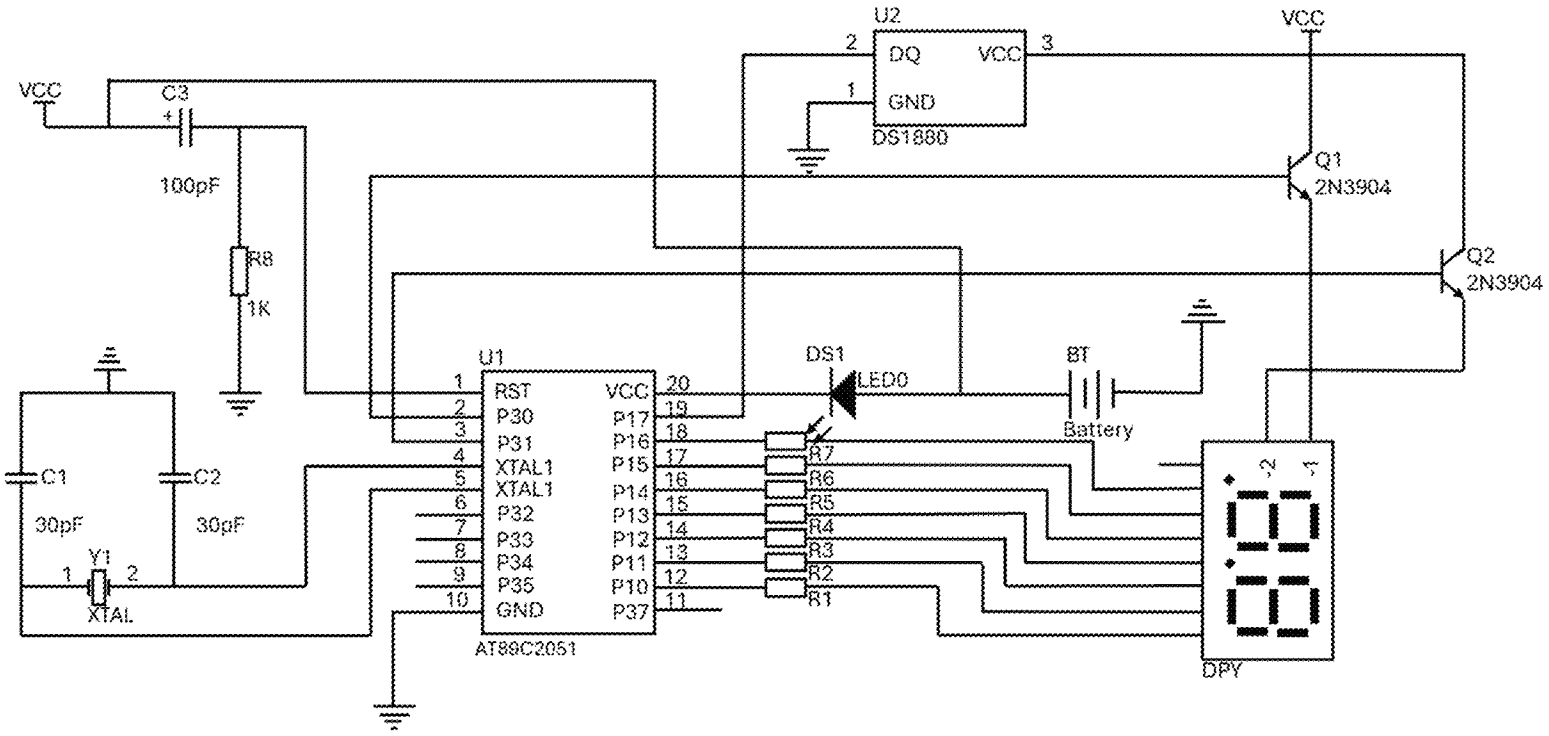
FIG. 10 depicts a schematic diagram illustrating a circuit of a thermal insulation backpack, provided in one embodiment of the present application.

By referring to FIG. 10, a temperature display screen 20 is connected to the main body 10; and a temperature sensor is connected in the thermal insulation accommodation cavity 102. The thermal insulation backpack further includes a master control chip U1; and the temperature display screen 20 and the temperature sensor are respectively connected with the master control chip U1.

Particularly, the master control chip U1 has a model of AT89C2051.

The temperature in the thermal insulation accommodation cavity 102 is tested at any time; and a user may be informed of cooling the products pending thermal insulation in case of the high temperature.

The master control chip U1 is also connected with a button cell 3V, and the master control chip U1 and the temperature sensor is switched on to operate. The temperature sensor changes a value of resistance with temperature changes, displaying the temperature in the thermal insulation accommodation cavity 102 on the temperature display screen 20 across resistors R7, R6, R5, R4, R3, R2, and R1 from a pin 2 of the temperature sensor to pins P17, P16, P15, P14, P13, P12, P11, and P10 of the master control chip U1, thereby testing the temperature of the thermal insulation accommodation cavity 102 in real time.

In the embodiment, the temperature sensor has a model of DS1820, and the temperature display screen 20 is but is not limited to a DPY 8 type pulse cell display.

A shoulder strap 11 is connected to a periphery of the main body 10, and a lifting strap 12 is connected to an upper end of the main body 10.

According to the thermal insulation backpack, the connection holes 101 are formed in the main body 10, the adapter assemblies 30 are inserted into the connection holes 101, and the connection recesses 316 are communicated with and separated from the first through slots 312 by the sealing screens 32, the sealing strips 321, and the return springs 35; when the thermal insulation accommodation cavity 102 needs to be cooled internally by the external cooling apparatus, the cold air outputted from the external cooling apparatus acts on the sealing screens 32, so that the sealing strips 321 are separated from the communication positions of the connection recesses 316 and the first through slots 312, which makes the cold air get into the thermal insulation accommodation cavity 102; or else, the sealing strips 321 are hermetically arranged at the communication positions of the connection recesses 316 and the first through slots 312 to seal the thermal insulation accommodation cavity 102, which achieves quick cooling without taking the products out of the thermal insulation accommodation cavity, while achieving the thermal-insulating effect. The thermal insulation backpack is applicable to the emergency circumstances, and is easy to operate.

In one embodiment, the present application further provides an operation method of the thermal insulation backpack, in which the thermal insulation backpack is used. The operation method includes:

When the thermal insulation backpack is in an initial state, each return spring 35 keeps an original length; each sealing screen 32 drives the sealing strip 321 to be arranged at the communication position of the connection recess 316 and the first through slot 312 under an action of the return spring 35, so that the connection recess 316 is not communicated with the first through slot 312.

When the thermal insulation backpack needs to be cooled, the external cooling apparatus is connected with the connection recess 316; the external cooling apparatus supplies the cold air, which acts on the sealing screen 32, so that the sealing screen 32 moves close to the thermal insulation accommodation cavity 102 to compress the return spring 35; and the connection recess 316 is communicated with the first through slot 312, so that the cold air passes through the connection recess 316, the first through slot 312, and each of the second through slots sequentially, and then, enters the thermal insulation accommodation cavity 102 for cooling.

It should be noted that a person skilled in the art may clearly understand that the implementation of the operation method of the thermal insulation backpack may be described with reference to the above embodiments of the thermal insulation backpack, which will not be described repeatedly herein for the purpose of the convenient and simplified description.

The previous descriptions are merely intended to further illustrate technical contents of the present application by the embodiments for a reader to understand more easily, which do not, however, mean that the implementation of the present application is limited thereto. Any technology extension or recreation made according to the present application should fall within the scope of the protection of the present application. The protection scope of the present application should follow the claims.

What is claimed is:

1. A thermal insulation backpack, characterized in that the backpack comprises a main body and one or more adapter assemblies, wherein the main body is internally provided with a thermal insulation accommodation cavity; connection holes are formed in the main body and are communicated with the thermal insulation accommodation cavity; each adapter assembly is inserted into a respective connection hole, and comprises a fixing frame, a sealing screen, and a reset assembly; the fixing frame comprises a frame body that presses against the respective connection hole and hooks which are connected inside the frame body, at least one hook is connected with the reset assembly, an outer periphery of the sealing screen is provided with a sealing strip protruding outward; a connection recess and a first through slot are formed in the frame body with the at least one hook arranged on an inner wall of the through slot; the first through slot is connected with the thermal insulation accommodation cavity; the sealing screen is connected with the reset assembly; when the adapter assembly is connected with an external cooling apparatus, the sealing screen moves to be close to an inside of the thermal insulation accommodation cavity, so that the connection recess is communicated with the first through slot; when the adapter assembly is not connected with the external cooling apparatus, the sealing screen moves away from the inside of the thermal insulation accommodation cavity; and the sealing strip presses against a lower end of the connection recess to avoid communication between the connection recess and the first through slot.

2. The thermal insulation backpack according to claim 1, characterized in that, the reset assembly comprises a connecting disc and a return spring;

the connecting disc is connected with each hook; a lower end of the return spring is connected with the connecting disc, and an upper end of the return spring is connected with the sealing screen; and the connecting disc presses against the connection hole.

3. The thermal insulation backpack according to claim 2, characterized in that, an upper end of the connecting disc extends upwards to form a connecting ring; the connecting ring is internally provided with a plurality of necks; and the hooks are connected in the necks.

4. The thermal insulation backpack according to claim 3, characterized in that, a fixing sheet is connected to an outer end of the connecting disc, and presses against an outer end of the connection hole; and an insert hole is formed in the fixing sheet, where the connecting disc is inserted.

5. The thermal insulation backpack according to claim 4, characterized in that, an inner wall of the insert hole is provided with a plurality of connecting blocks protruding inward, which are connected with the frame body; a second through slot is formed between the adjacent connecting blocks; and the first through slots, the second through slots, and the thermal insulation accommodation cavity are communicated with each other.

6. The thermal insulation backpack according to claim 5, characterized in that, a connector is connected to an upper end of the sealing screen, and comprises a connecting tube; a bar-type groove is formed in a side wall of the connecting tube; and a seal sheet is arranged at the connecting tube at one end close to the sealing screen.

7. The thermal insulation backpack according to claim 1, characterized in that, a temperature display screen is connected to the main body; and a temperature sensor is connected in the thermal insulation accommodation cavity; the thermal insulation backpack further comprises a master control chip U1; and the temperature display screen and the temperature sensor are respectively connected with the master control chip U1.

8. The thermal insulation backpack according to claim 7, characterized in that, the master control chip Ul has a model of AT89C2051.

9. An operation method of the thermal insulation backpack, involving with the thermal insulation backpack as claimed in claim 7, characterized in that, the method comprises:

when the thermal insulation backpack is in an initial state, the return spring keeps an original length; the sealing screen drives the sealing strip to be at a communication position of the connection recess and the first through slot under an action of the return spring, so that the connection recess is not communicated with the first through slot;

when the thermal insulation backpack needs to be cooled, the external cooling apparatus is connected with the connection recess; the external cooling apparatus supplies cold air, which acts on the sealing screen, so that the sealing screen moves to be close to the thermal insulation accommodation cavity, the return spring is compressed and the connection recess is communicated with the first through slot, so that the cold air passes through the connection recess, the first through slot, and each of the second through slots sequentially, and then, enters the thermal insulation accommodation cavity for cooling.

* * * * *